United States Patent [19]

Scott, Jr. et al.

[11] 3,973,076

[45] Aug. 3, 1976

[54] FURNACE FOR MELTING HIGHLY CORROSIVE SLAG

[75] Inventors: William W. Scott, Jr., Parkesburg; Charles D. Guth, Coatesville, both of Pa.

[73] Assignee: Lukens Steel Company, Coatesville, Pa.

[22] Filed: Nov. 27, 1974

[21] Appl. No.: 527,842

Related U.S. Application Data

[63] Continuation-in-part of Ser. No. 367,941, June 7, 1973, Pat. No. 3,905,804.

[52] U.S. Cl. ..... 13/35; 13/10

[51] Int. Cl.[2] ..... F27D 1/04

[58] Field of Search ..... 13/10, 35; 266/43

[56] References Cited

UNITED STATES PATENTS

| | | | |
|---|---|---|---|
| 842,099 | 1/1907 | Landis | 13/35 |
| 3,218,050 | 11/1965 | Healy et al. | 13/35 X |
| 3,345,059 | 10/1967 | Swindt | 266/43 |
| 3,835,231 | 9/1974 | Marchner | 13/10 |

*Primary Examiner*—R. N. Envall, Jr.
*Attorney, Agent, or Firm*—Mason, Mason & Albright

[57] ABSTRACT

A carbon brick/graphite lined furnace for melting, containing and pouring a special purpose slag composed of about 40 percent $CaF_2$, 30 percent CaO and 30 percent $Al_2O_3$ or a slag composed of about 70 percent $CaF_2$ and 30 percent $Al_2O_3$ which has a cylindrical configuration and a roof composed of high alumina ram refractory with openings therein for receiving heating electrodes composed of graphite, for feeding dry slag into the furnace and for exhausting fumes therefrom. The furnace has a pouring spout and the roof can be raised whereby the furnace is turnable about trunions for discharging the molten slag into an electroslag remelting process mold. Both the interior lining and the next surrounding lining are composed of graphite or carbon bricks or a combination thereof. An expansion layer of insulating material, powder alumina, surrounds the second lining. Following this are two further linings of refractory material. A steel shell is provided with a layer of compressed material of high temperature insulation packed between such shell and the last layer of refractory brick. On the bottom of the furnace, two successive circular shaped graphite discs or plates are provided under which are two layers of refractory material. The steel shell at the bottom is convex and contains a further layer of castable insulating fireclay refractory. The pouring spout of the furnace comprises an upwardly inclined channel at the upper edge of the furnace which is lined with graphite brick. The last part of the channel for discharging molten slag is a readily replaceable single graphite or high alumina ram refractory block which extends outwardly from the cylindrical surface of the furnace.

18 Claims, 4 Drawing Figures

FURNACE FOR MELTING HIGHLY CORROSIVE SLAG

RELATED APPLICATIONS

This is a continuation-in-part of application Ser. No. 367,941 filed June 7, 1973 now U.S. Pat. No. 3,905,804.

BACKGROUND OF THE INVENTION

The electroslag remelting process essentially comprises the fusing from a consumable electrode of metal to be refined under a blanket of molten slag. The molten slag is introduced into the mold and acts as an electrical conductor for the electrical current passing between the consumable electrode and the base plate of the mold. The current heats the molten slag, and in turn, the electrode and drops of the metal fuse off of its lower end and fall to the bottom of the mold where a pool of molten metal forms and solidifies upwardly. A refining action takes place in the molten metal drops as they pass through the molten slag. As the electrode is progressively consumed, the refined metal builds up from the bottom of the mold with the molten slag floating on the pool of refined metal and being maintained in contact with the lower end of the consumable electrode. The refining process through the slag continues until the electrode is consumed or substantially consumed.

Special slags are generally used in the electroslag refining process. Although they have a high dielectric constant in the solid form, they are conductive to some extent in the liquid phase. Moreover, in the molten state, slag with a significant portion of calcium fluoride is highly liquid and has a corrosive effect on ordinary refractory. In view of this characteristic, furnaces for melting such slag prior to introducing same into the electroslag mold often comprise specially formed graphite. However, such graphite furnaces are frequently expensive and their construction may add substantially to the cost of the electroslag refining process. On the other hand, furnaces which include bricks composed of other than graphite often have to be replaced which necessarily takes the furnace out of the production and, unless a replacement is provided, may hold up production for uncertain periods with resulting additional costs and inefficiency. A need thus exists for a slag melting furnace for the electroslag refining process which is reasonable in cost, effective and efficient in operation and which can be utilized for comparative extended periods without the requirement for undue repairs or rebricking.

SUMMARY OF THE INVENTION

The instant invention relates to a slag melting furnace for use in the electroslag refining process and more particularly to such a furnace which is provided with an effective lining of carbon or graphite or a combination thereof whereby the furnace is operable for a reasonable period of time and resistant to the corrosive effects of the calcium fluoride which is a usual constituent in such slag.

It has been found that an effective and efficient furnace for melting and containing the slag for the electroslag refining process is obtainable through the employment of graphite or carbon bricks in a pair of linings with overlapping bricks which are further surrounded by an expansion layer of insulating material, powdered alumina, surrounded again by two further layers of refractory brick which, except for the protective protection of the carbon or graphite layers, would be rapidly depleted by the corrosive effects of the calcium fluoride. The furnace is tiltable whereby the slag can be poured therefrom into the electroslag refining mold and the pouring spout and the area about the pouring spout may be either formed of carbon or graphite bricks or composed of high temperature rammed alumina. The spout itself is constructed and placed in the furnace so that it is readily replaced.

A furnace manufactured in accordance with the invention has a capacity of about 1½ tons of slag or at least about 2800 pounds. It can be tilted to over 90° to insure that it is emptied, carries the molten slag at a temperature of up to 280° – 2900°F. and may be used for over 100 heats with the graphite or carbon brick working lining replaced only every twenty-five heats, more or less. Except for carbon which can be effectively removed as set forth in copending application Ser. No. 367,941, deleterious elements are not introduced into the slag from the furnace during the melting process whereby in use in mold of the electroslag refining process, the molten slag fluxes out impurities in the steel in a known and desirable manner.

A furnace for the melting of slag in the electroslag refining process having the foregoing advantages is the principal object of this invention. However, other objects, adaptabilities and capabilities of the invention will be understood by those skilled in the art as the description progresses, reference being had to accompanying drawings in which:

DESCRIPTION OF THE PREFERRED EMBODIMENT

Figure 1:
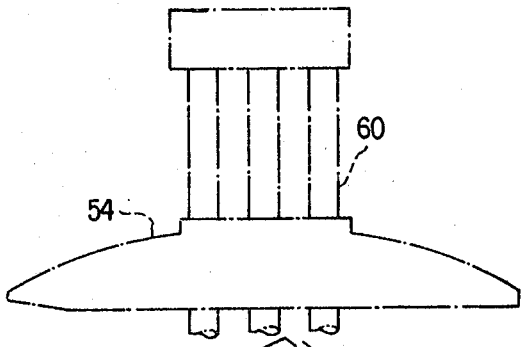
FIG. 1 is a schematic elevational view of a furnace in accordance with the invention which is partly in section and shows the furnace roof lifted and the furnace tipped in dot-dash lines.
Figure 3:
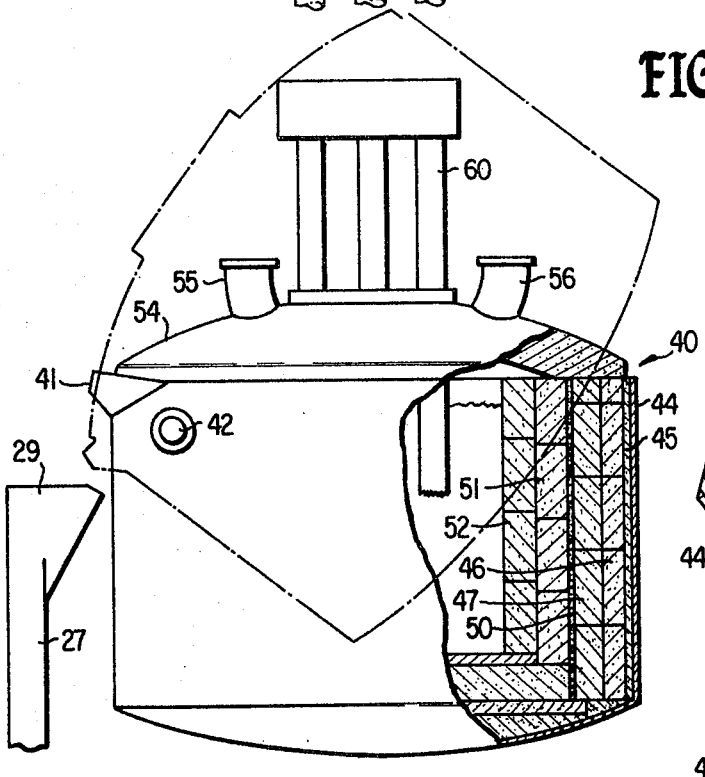
FIG. 3 is a side sectional view including the pouring spout of the furnace.

Referring to the figures, a funnel portion 29 is shown in FIG. 1 which is disposed to receive molten slag from spout 41 of the slag furnace 40 when it is pivoted around trunnion 42 as indicated in dot-dash lines. The funnel portion 29 leads via a conduit 27 to the mold used in the electroslag refining process which is not shown in this disclosure.

Figure 4:
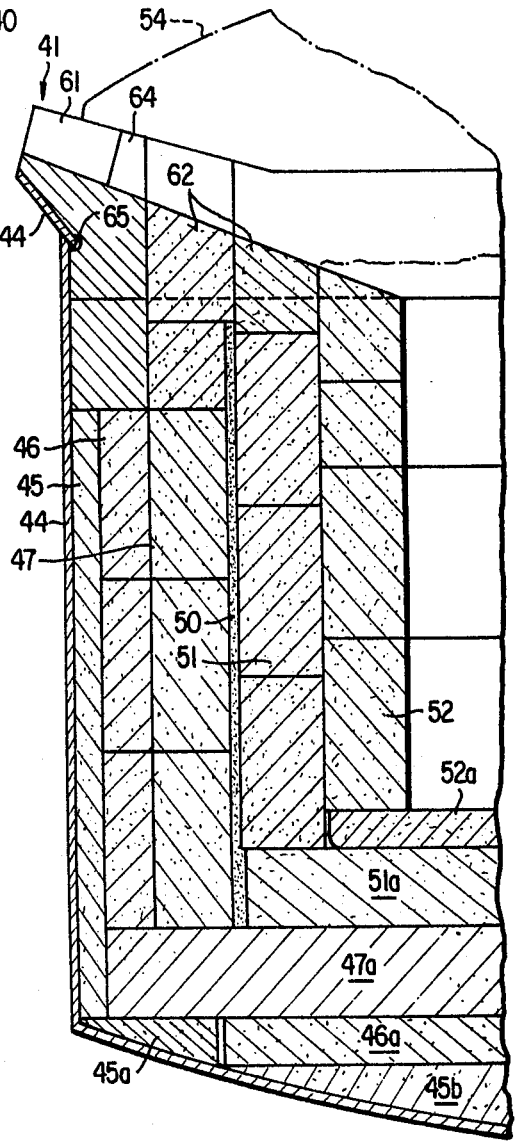
FIG. 4 is an elevational view of a nozzle block used in the invention.
Figure 4:
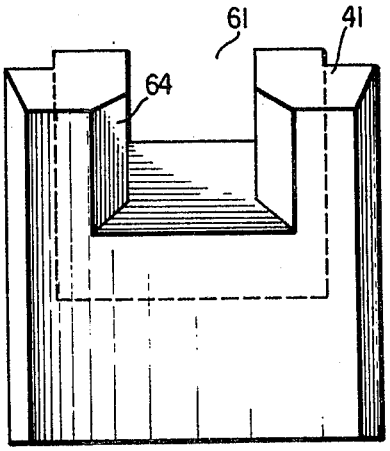
Figure 2:
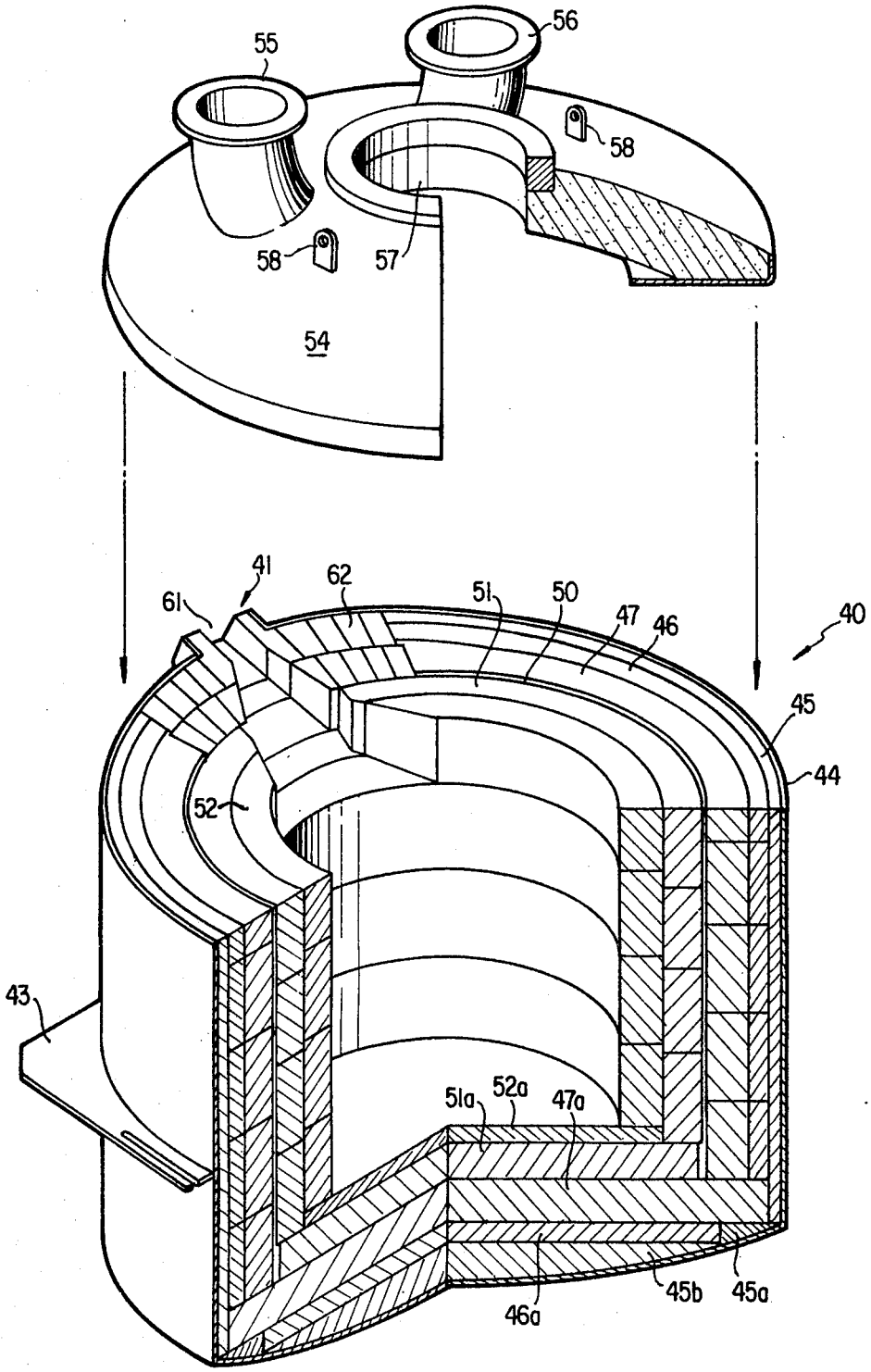
FIG. 2 is a perspective view of the furnace in accordance with the invention with the roof shown above the furnace, as such, and both components in partial section.

Slag furnace 40 comprises an outer steel shell 44 followed by a layer of compressible fibrous high temperature (2300°F) insulation 45, insulating fire brick 46, a layer of high alumina "bubble" type refractory bricks 47, and expansion joint 50 comprising powdered alumina, a graphite outer shell 51 which may be integral and have the shape of a cup or be formed of graphite or carbon bricks as shown and finally on the interior and exposed to the slag an inner layer of graphite or carbon bricks 52. The roof 54 is composed of a high alumina ram refractory which is tamped into place to form a monolithic roof structure. The roof includes three main openings an exhaust conduit 55, a feed pipe 56, and a central opening 57 which receives three graphite electrodes 60 which are connected to an appropriate electrical power source, not shown. Prior to pivoting the electroslag furnace 40 about trunnions 42, electrodes 60 and roof 54 are raised to the position shown in dot-dash lines in FIG. 1. The roof is lifted by means of cables or steel bars which connect to a plurality of suspension hangers 58. As seen in FIG. 2, a plate 43 may be provided which is basically a slag splash plate. It will be noted that the spout 41 is provided with a channel 61 and it is surrounded by a plurality of carbon or graphite bricks 62. Spout 41 consists of the nozzle block as shown in FIG. 4 and in practice channel 61 is about 3½ inches in width and the after portion includes flared sides 64. In its forward more or less central portion, the nozzle block 41 is provided with a notch 65 which receives the angle created between the shell 44 and a supporting plate 44*a* for providing support under the lower portion of the nozzle block 41.

On the underside or bottom of the furnace 40 a graphite plate or disc 52*a* is provided which has underlying it a further and larger graphite plate or disc 51*a*. Under this are two layers high purity alumina "bubble" type brick 46*a* and 47*a* which are disposed in an overlapping manner and finally between the convex portion of the bottom of the shell 44 and the refractory brick layer 46*a* further castable insulating fireclay - (2800°F) 45*b*, similar to insulation 46, is provided. The same is true of the insulation 45*a* which is between the bottom portion of steel shell 44, the edge of the fire brick layer 46*a* and under the fire brick layer 47*a*.

In operation, dry slag is placed within the slag furnace 40 and heated by graphite electrodes 60 until, due to its resistance, it is melted and the electrodes are immersed in the slag which is heated to a temperature of 2800° – 2900°F. prior to tapping.

It has been found that slag furnace 40 has very few problems and may be used for one hundred heats with the carbon or graphite bricks 52 replaced every 25 heats more or less. Moreover, although the nozzle block 41 was originally made of graphite, it has been found that high alumina ram refractory may be utilized in its place and it may be readily replaced as previously indicated.

When the slag furnace is caused by appropriate means (not shown) to tilt about trunnion 42, it is capable of tilting more than 90° whereby all the slag may be poured into the funnel portion 29 of conduit 27 whereupon it enters from conduit 27 into the electroslag refining process mold, not shown.

As set forth previously, the furnace 40 has a capacity of about 1½ tons of slag or at least about 2800 pounds. It takes about 1½ to 2 hours to melt and bring 1,000 pounds of slag to the desired temperature. Thus, for 2800 pounds, the required time is about 3½ – 4 hours. The slag charging time via funnel portion 29 does not normally exceed four minutes.

For the purpose of the above disclosure and the claims, the term "slag" also includes the term "flux." Further, although the furnace may be utilized for slags which do not contain calcium fluoride, it was designed for such slags — that is slags which have a significant amount of calcium fluoride, say about ten percent or more whereby ordinary fire brick would soon be undesirably corroded by the calcium fluoride. Although the preferred embodiment of this invention is described above, it is to be understood that it is capable of other adaptations and modifications within the scope of the following claims.

Having thus described our invention, what we claim as new and desire to secure by Letters Patent of the United States:

1. A furnace for slag containing at least ten percent calcium fluoride which comprises a first inner liner composed of carbon, a second liner surrounding first liner and in continuous juxtaposition therewith also composed of carbon and a third liner of refractory brick surrounding said second liner, said first liner having at least one horizontal interstice below the normal slag level of the furnace, said second liner being without any horizontal interstice at the same level as said firstmentioned horizontal interstice, a material which provides for the expansion comprising a layer between said second and third layers, a fourth liner of refractory bricks surrounding and in continuous juxtaposition with said third liner, a layer of insulation provided around said fourth liner and a steel shell provided for the furnace surrounding said liners and said expansion layer, said liners and said layer being cylindrical in shape, a roof being included in the furnace which is comprised of heat-insulating material, an opening in the central area of said roof adapted to receive an electrode for heating slag in the furnace, a spout provided in the upper part of the furnace for the discharge of slag from the furnace.

2. A furnace in accordance with claim 1 wherein said roof includes hangers whereby it can be lifted away from the remainder of the furnace which is provided with means for tipping for discharging of slag therefrom.

3. A furnace in accordance with claim 1 wherein said spout is lined with material composed of carbon.

4. A furnace in accordance with claim 1, wherein said first liner comprises graphite bricks with said first mentioned horizontal interstice between them.

5. A furnace in accordance with claim 4, wherein said first liner includes a bottom which comprises an integral plate of graphite and wherein said bricks of said first liner are directly supported by said integral plate.

6. A furnace in accordance with claim 5 wherein said first liner is cylindrical in shape and said plate of graphite has the shape of a circular disc.

7. A furnace in accordance with claim 5, wherein said second liner includes a further bottom which comprises an integral further plate of graphite and wherein said second liner is directly supported by said second plate.

8. A furnace in accordance with claim 7 wherein said second liner is cylindrical in shape.

9. A furnace in accordance with claim 7 wherein two layers of refractory material underlie said further bottom.

10. A vessel for containing liquid slag which includes at least ten percent calcium fluoride, the vessel comprising a first interior lining of a plurality of levels of carbon or graphite bricks, horizontal interstices between successive said levels of said carbon or graphite bricks, a second interior lining surrounding and behind said first lining composed of graphite or carbon, said second lining not having any horizontal interstices which are at the same level of any of said first mentioned interstices, a third lining surrounding and behind said second lining of refractory insulating material, a layer of expansion material between said second and third lining and an outer shell composed of metal, the vessel including a roof composed of refractory material and means for removing said roof from the remainder of the vessel, a pouring spout in the vessel immediately under said roof and means for tilting the vessel for pouring out said liquid slag via said pouring spout when said roof is removed.

11. A vessel in accordance with claim 10 wherein said roof includes an opening for receiving an electrode for heating said slag in said vessel.

12. A vessel in accordance with claim 11 wherein said roof includes further openings for placing slag in the vessel and for exhausting fumes therefrom.

13. A vessel in accordance with claim 10 comprising a further lining of graphite provided for said pouring spout.

14. A vessel in accordance with claim 13, wherein said pouring spout comprises a channel which is open on its upper side, said channel being defined in part by a single integral graphite block which includes a nozzle part from which slag is discharged out of the container.

15. A vessel in accordance with claim 13 wherein said shell is cylindrical in shape, said nozzle part extending beyond the cylindrical surface of said shell.

16. A vessel in accordance with claim 15 wherein said second lining comprises graphite brick.

17. A vessel in accordance with claim 13 wherein said pouring spout comprises a channel, said channel being defined in part by a single integral block of high alumina ram refractory which includes a nozzle part from which said slag is discharged out of said container.

18. A vessel in accordance with claim 17 wherein said shell is cylindrical in shape, said nozzle part extending beyond the cylindrical surface of said shell.

* * * * *